US005774899A

United States Patent [19]

Griffin

[11] Patent Number: 5,774,899

[45] **Date of Patent: *Jul. 7, 1998**

[54] SUSPENDERS

[76] Inventor: David J. Griffin, 300 E. 40th St., Apt. 19M, New York, N.Y. 10016

[ * ] Notice: The term of this patent shall not extend beyond the expiration date of Pat. No. 5,682,619.

[21] Appl. No.: 882,646

[22] Filed: Jun. 25, 1997

Related U.S. Application Data

[62] Division of Ser. No. 736,511, Oct. 24, 1996, Pat. No. 5,682,619.

[51] Int. Cl.[6] ..... A41F 3/00

[52] U.S. Cl. ..... 2/326; 2/102

[58] Field of Search ..... 2/102, 103, 106, 2/115, 77, 326–329, 129, 130, 132–134

[56] References Cited

U.S. PATENT DOCUMENTS

| | | | |
|---|---|---|---|
| D. 126,586 | 4/1941 | Kasarda | D2/207 |
| 790,314 | 5/1905 | Robertson | 2/103 |
| 1,118,572 | 11/1914 | Nigh | 2/103 |
| 1,798,056 | 3/1931 | Bean | 2/115 |
| 2,502,921 | 4/1950 | Bryant | 2/115 |
| 5,036,549 | 8/1991 | Jackson | 2/102 |
| 5,117,538 | 6/1992 | Henry | 24/298 |
| 5,230,451 | 7/1993 | Onozawa | 224/194 |
| 5,682,619 | 11/1997 | Griffin | 2/326 |

*Primary Examiner*—Gloria M. Hale
*Attorney, Agent, or Firm*—Schweitzer Cornman Gross & Bondell LLP

[57] ABSTRACT

A suspender, with a collar section adapted to conform to the lower back of the neck of a person, has two side portions connected to the collar section, each side portion having attachment means at the end thereof for securing the suspender to opposite sides of the front of a garment. The collar substantially encircles the neck of the person, and includes a means to clasp the two front ends. The side portions are connected to corner regions of the collar front ends. The new suspender is unique in appearance and function.

6 Claims, 3 Drawing Sheets

SUSPENDERS

RELATED APPLICATIONS

This application is a divisional of application Ser. No. 08/736,511, filed Oct. 24, 1996, now U.S. Pat. No. 5,682,619.

FIELD OF THE INVENTION

This invention pertains to the field of clothing and, in particular, to suspenders.

BACKGROUND AND SUMMARY OF THE INVENTION

Typical pants suspenders designs are largely utilitarian with two plain side straps and a similarly plain back strap. The back strap connects to the center of the back of the waistband and the side straps arc over the shoulders of the wearer and connect to opposite sides of the front waistband such that the shoulders of the wearer provide the support for the suspenders and ultimately the pants. Various material types and patterns have been used to enhance the appearance of prior suspenders. However, the underlying design remains unchanged.

The suspender of the present invention is a novelty suspender of unique construction and appearance which combines both form and function. The present suspender includes a length of fabric having two side portions and a central collar section. Each side portion includes an end with means to attach to a waistband of a pair of pants. The collar section is adapted to conform to the neck of the wearer. The suspender, as worn, attaches to one side of the front waistband, loops around the neck of the wearer, and attaches to the opposite side of the front waistband. The side portions include means to adjust the length of the suspender and are adapted to lie flat against the chest of the wearer. The collar section is adapted to conform to the curvature of the lower nape of the neck of the wearer (i.e. the lower portion of the back of the neck) and to substantially encircle the entire neck of a person similar to a shirt collar. The side portions may be attractively configured to include lapels, pockets, and button holes.

BRIEF DESCRIPTION OF THE DRAWINGS

For a more complete understanding of the above and other features and advantages of the invention, reference should be made to the following detailed description of preferred embodiments of the invention and to the accompanying drawing, wherein.

DETAILED DESCRIPTION OF THE INVENTION

Figure 1:
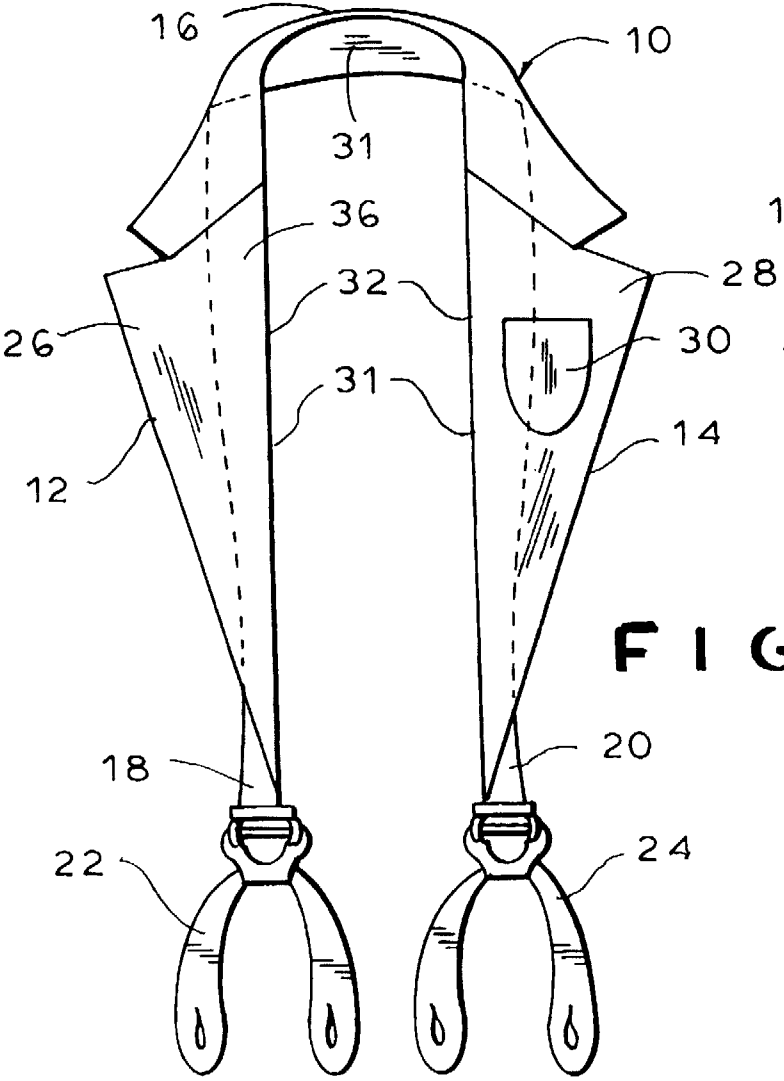
FIG. 1 is a front view of a suspender made in accordance with the present invention.
Figure 2:
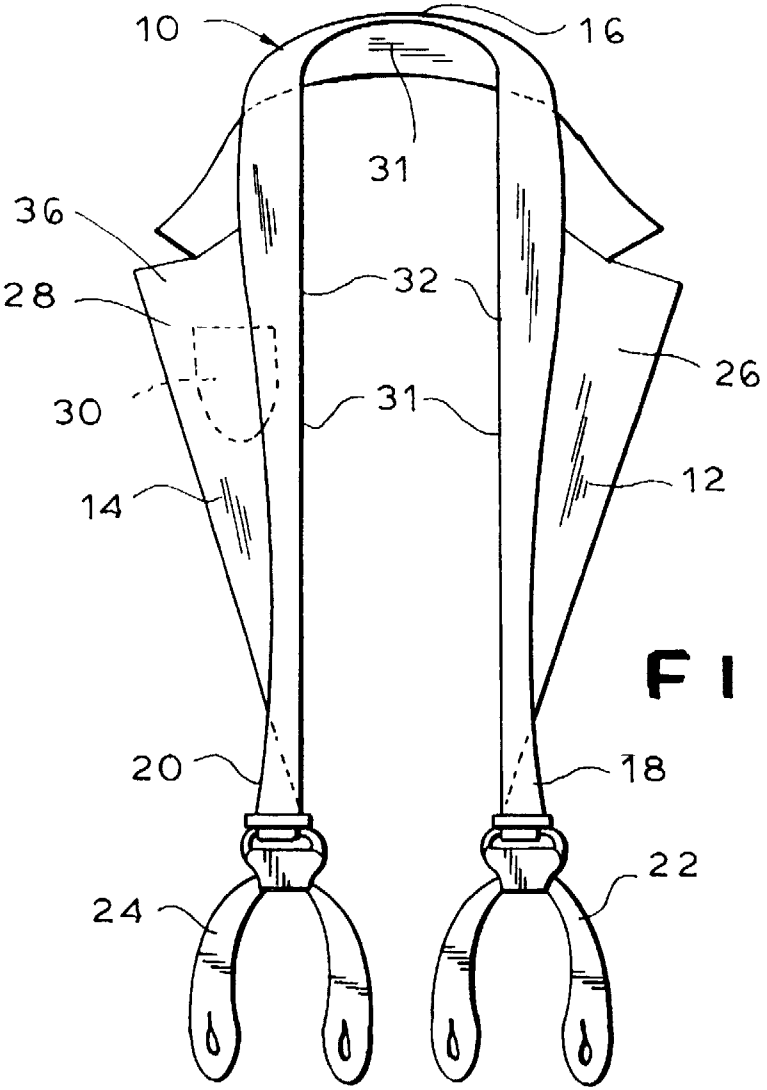
FIG. 2 is a rear view of the suspender of FIG. 1.

Referring to FIGS. 1 and 2, a suspender 10 constructed in accordance with the present invention comprises a length of flexible material, formed of one or more fabric sections and having two side portions 12, 14 separated by a collar section 16. The side portions 12, 14 include ends 18, 20 with means to attach 22, 24 to a waistband, such as the U-straps depicted.

The side portions 12, 14 are adapted to lie flat against the chest of the wearer and the collar section 16 is adapted to conform to the curvature of the lower nape of the neck of the wearer and in one preferred embodiment to substantially encircle the neck of the user. That is, the collar section adapts to the lower portion of the back of the neck, generally in the same area where a standard shirt collar rests.

The side portions 12, 14 and the collar section 16 comfortably direct any and all tension in the material of a properly adjusted suspender 10 to the collar and neck regions of the wearer. Therefore, the suspender 10 provides complete support without the need for a back strap. Also, the collar portion 16 serves to connect the side portions 12, 14 together and thereby prevents the side portions 12, 14 from sliding out of position. Also, the position of the side portions 12, 14 allows them to be adapted to form various collar lapel styles, such as the notch collar depicted.

The suspender 10 can include a fold 31 along an inner edge 32 thereof creating inner and outer layers 34, 36. Along the collar section 16, the inner and outer layers 32, 34 preferably are of generally equal width, forming a two-ply collar section 16. The outer layers 36 are preferably wider than the inner layers 34 along the majority of the length of the side portions 12, 14 such that the outer layers can be configured in the form of lapels 26, 28. As shown in FIGS. 1–4, the lapels 26, 28 can mimic common styles such as a business suit or a tuxedo with a notch collar as shown. Preferably the lapels 26, 28 begin near the ends 18, 20 and extend the full length of the side portions 12, 14. Also, preferably the lapels are partially raised by the inner layers 34 where the inner and outer layers 34, 36 overlap. This provides an impression that the lapels 26, 28 are somewhat raised from the wearer. Additionally, the lapels 26, 28 can include other features such as a pocket 30.

As indicated in FIG. 1, the inner fabric layers 34 of each side portion extend below the lower extremities of the outer layers 36, forming the ends 18, 20 which connect to the attaching means 22, 24. This provides a desirable appearance feature, that the lapels 26, 28 are somewhat separate and distinct from the suspender garment 10. Such a perception can be enhanced if the inner and outer layers of the suspender 10 have exposed surfaces with different appearances or textures. For example, the outward-facing surfaces of the outer layers 36, forming lapels 26, 28, could have a relatively satin-like appearance whereas the outward-facing surface of the inner layers 34, and thus the exposed end portions 18, 20, could have a flat finish.

Figure 3:
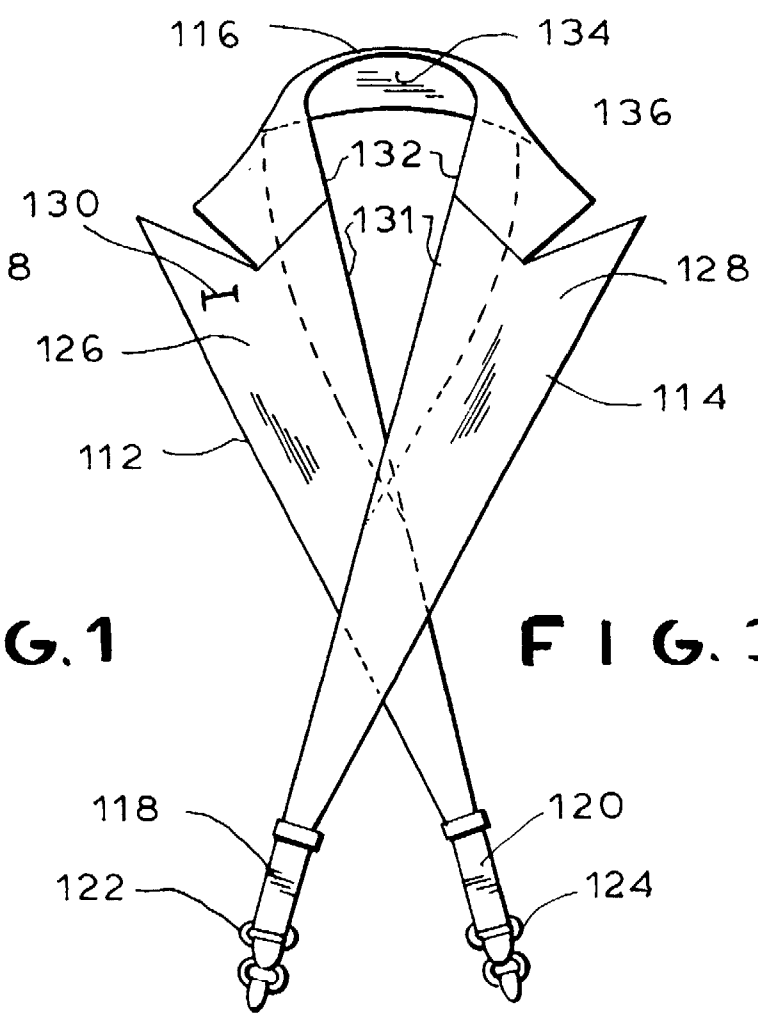
FIG. 3 is a front view of a second embodiment of the present invention.
Figure 4:
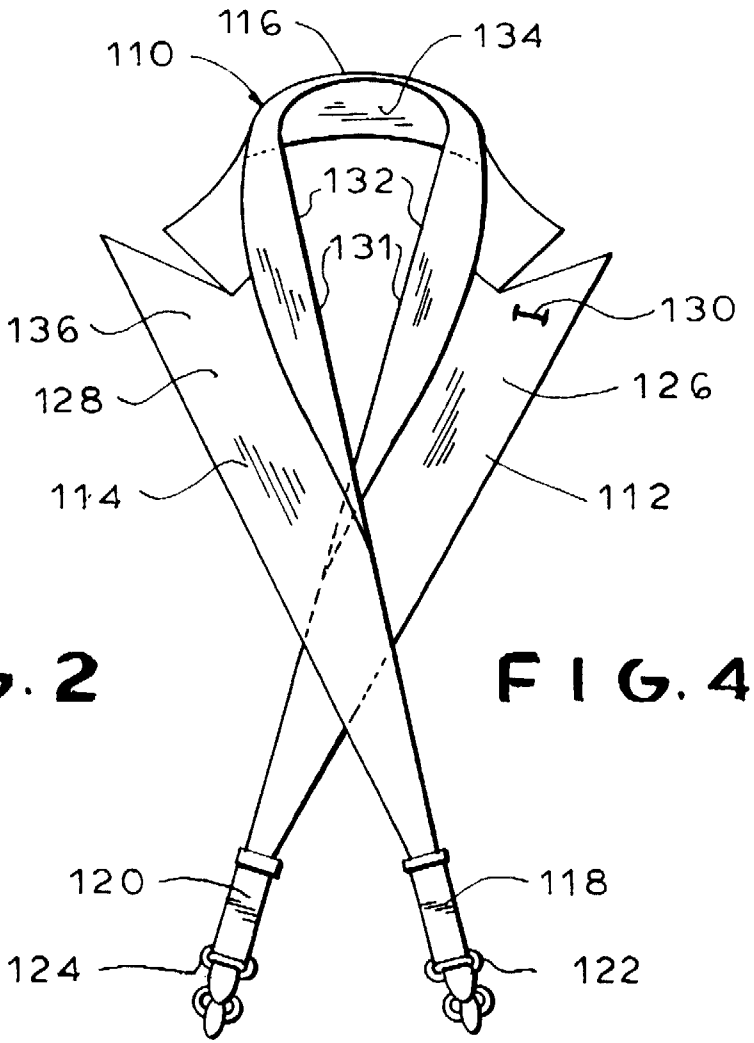
FIG. 4 is a rear view of the suspender of FIG. 3.

Referring to FIGS. 3 and 4, illustrating a second embodiment of the invention, each side portion 112, 114 can include a fold 131 beginning near an intermediate portion of the inner edge 132 thereof, forming inner and outer layers 134, 136. As in the first described embodiment, the outer layers 136 are wider than the inner layers 134 forming lapels 126, 128 which extend the full length of the side portions 112, 114. In contrast to the first embodiment, however, the inner layers 134 do not extend to the ends 118, 120 of the side portions 112, 114. Therefore, the attaching means 122, 124 (here shown as clips) connect to the outer layers 136.

As shown in FIGS. 3 and 4, the respective side portions 112, 114 can be crossed over as a surplice collar, if desired, to provide a more secure fit or a different appearance. This can be done with other embodiments as well. Also, the lapels 126, 128 can include other features, such as the button hole 130 depicted.

Figure 5:
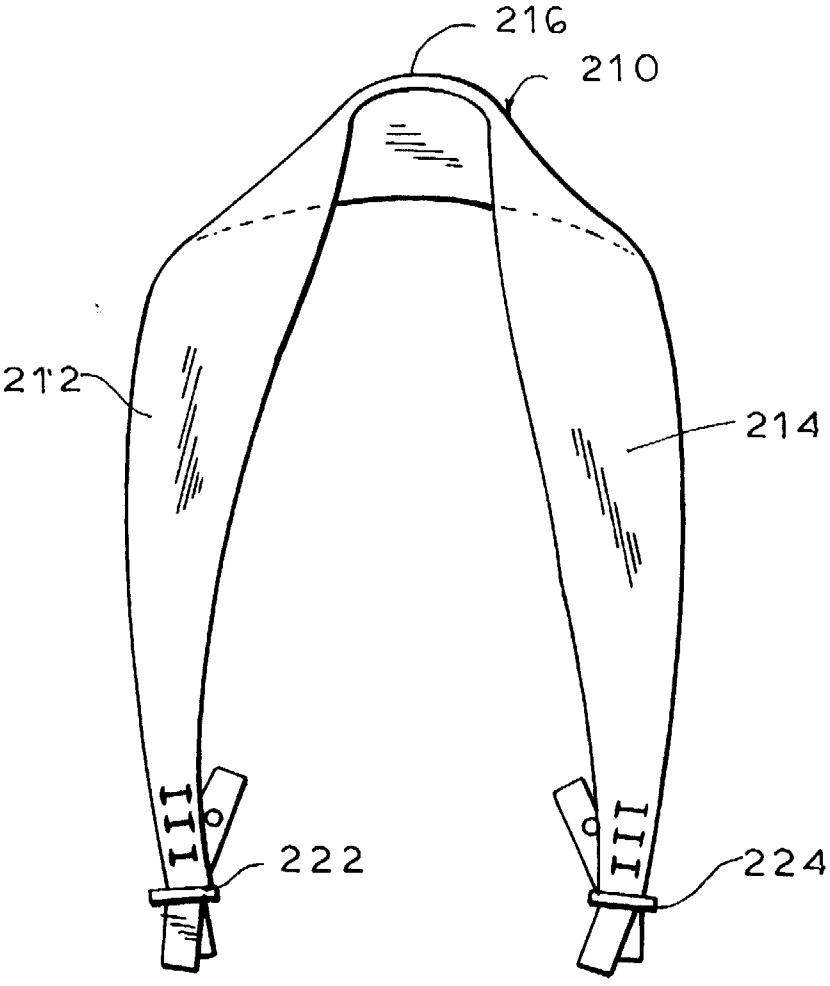
FIG. 5 is a front view of a third embodiment of the invention.

Referring to FIG. 5, a third embodiment of the invention includes side portions 212, 214 with soft lapels in the nature of a shawl collar arrangement, separated by a collar section 216. The suspender 210 can consist of one layer of material therefore the side portions 212, 214 connect directly to attaching means 222, 224, which can be clips as depicted. Alternatively, the suspender 210 can include a fold along an inner edge (not shown) forming inner and outer layers (also not shown). The side portions 212, 214 can include other features such as a pocket (not shown). Also, the suspender 210 can be worn in a crossed, or surplice collar configuration.

Figure 6:
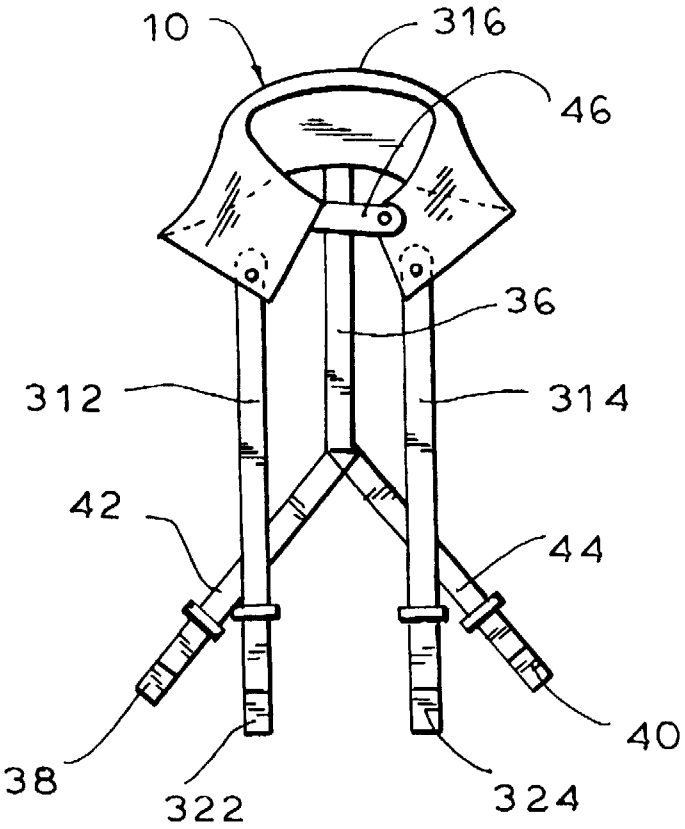
FIG. 6 is a front view of a fourth embodiment of the present invention.

Referring to FIG. 6, a fourth embodiment of the invention is illustrated, which includes a collar section 316, two side portions 312, 314 and a back portion 36. The two side portions 312, 314 and the back portion 36 all include attaching means 322, 324, 38 and 40 as shown. The back portion 36 can have two ends 42, 44, each with independent attaching means 38, 40. The collar 316 preferably has somewhat the form and appearance of a standard shirt collar. Also, the collar 316 preferably includes a clasp 46 to close the collar substantially around the entire neck of the wearer. However, as shown, the clasp 46 can hold the end portions 48 of the collar in a spaced-apart relation. The side portions 312, 314 and the back portion 36 can have the form and appearance of standard suspender straps or can have other shapes.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A suspender for a garment having a front portion, said suspender comprising:

a collar section adapted to conform to the lower back of the neck of a person;

said collar section being adapted to substantially encircle the entire neck of a person and comprising two front ends and a means to clasp said two front ends;

two side portions connected to said collar section, each side portion having an end with an attachment means adapted to connect to the front portion of the garment;

whereby the garment can be suspended on a person by securing the respective attachment means to the front portion of the garment, with the collar section disposed around the lower back portion of the person's neck, and the clasp means engaged.

2. A suspender as in claim 1, wherein:

(a) said two front ends of said collar section each further comprise a lower corner having edges extending upwardly therefrom, said lower corners being the lowest portions of said collar; and (b) said side portions are connected to said collar adjacent said lower corners.

3. A suspender as in claim 3, wherein said clasp means holds said two front ends in spaced-apart relation.

4. A suspender as in claim 1, further comprising a back portion connected to a back of said collar section, said back portion including means to attach to a back of said garment.

5. A suspender as in claim 4, wherein said back portion includes two end portions each having independent attachment means.

6. A suspender as in claim 4, wherein said side and back portions comprise straps having substantially similar characteristics.

* * * * *